US008836603B2

(12) United States Patent
Hanazawa et al.

(10) Patent No.: US 8,836,603 B2
(45) Date of Patent: Sep. 16, 2014

(54) ANTENNA DEVICE

(75) Inventors: Masahiro Hanazawa, Aichi-ken (JP); Nobuhiro Ide, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 357 days.

(21) Appl. No.: 13/260,794

(22) PCT Filed: Apr. 1, 2010

(86) PCT No.: PCT/IB2010/000750

§ 371 (c)(1),
(2), (4) Date: Oct. 17, 2011

(87) PCT Pub. No.: WO2010/113029

PCT Pub. Date: Oct. 7, 2010

(65) Prior Publication Data

US 2012/0038538 A1 Feb. 16, 2012

(30) Foreign Application Priority Data

Apr. 3, 2009 (JP) ..... 2009-091534

(51) Int. Cl.

| | |
|---|---|
| ***H01Q 21/00*** | (2006.01) |
| ***H01Q 11/12*** | (2006.01) |
| ***H01Q 9/46*** | (2006.01) |
| ***H01Q 7/00*** | (2006.01) |
| ***H01Q 21/29*** | (2006.01) |
| ***H01Q 3/24*** | (2006.01) |

(52) U.S. Cl.

CPC . *H01Q 3/24* (2013.01); *H01Q 9/46* (2013.01); *H01Q 7/005* (2013.01); *H01Q 21/29* (2013.01)

USPC ..... 343/867; 343/744; 343/742

(58) Field of Classification Search

USPC ..... 343/731, 732, 733, 734, 736, 737, 741, 343/742, 744, 748, 749, 750, 751, 752, 867

See application file for complete search history.

(56) References Cited

U.S. PATENT DOCUMENTS

| | | | | |
|---|---|---|---|---|
| 3,605,097 | A * | 9/1971 | Hadik-Barkoczy | 343/739 |
| 3,680,135 | A * | 7/1972 | Boyer | 343/742 |
| 3,818,480 | A * | 6/1974 | West | 342/435 |

(Continued)

FOREIGN PATENT DOCUMENTS

| | | |
|---|---|---|
| EP | 1 113 523 A1 | 7/2001 |
| JP | A-02-125503 | 5/1990 |

(Continued)

OTHER PUBLICATIONS

Jul. 27, 2010 International Search Report issued in International Application No. PCT/IB2010/000750.

(Continued)

*Primary Examiner* — Hoang V Nguyen
*Assistant Examiner* — Patrick Holecek
(74) *Attorney, Agent, or Firm* — Oliff PLC

(57) ABSTRACT

An antenna device includes: a plurality of loop metal wires that form loops out of metal wires and that are radially arranged around a center line; a power feeding portion that feeds power to the loop metal wires or a power receiving portion that receives power from the loop metal wires and that is provided on the center line; and a variable impedance element that is inserted in each of the loop metal wires.

7 Claims, 7 Drawing Sheets

(56) References Cited

U.S. PATENT DOCUMENTS

| | | | | |
|---|---|---|---|---|
| 5,235,343 | A | 8/1993 | Audren et al. | |
| 8,193,989 | B2 * | 6/2012 | Fujita et al. | 343/700 MS |
| 2005/0280589 | A1 | 12/2005 | Chiang et al. | |
| 2008/0266190 | A1 | 10/2008 | Ohba et al. | |

FOREIGN PATENT DOCUMENTS

| | | | |
|---|---|---|---|
| JP | A-08-065032 | | 3/1996 |
| JP | A-09-260925 | | 10/1997 |
| JP | A-10-242736 | | 9/1998 |
| JP | A-2001-024431 | | 1/2001 |
| JP | A-2002-359515 | | 12/2002 |
| JP | A-2005-020289 | | 1/2005 |
| JP | A-2006-005645 | | 1/2006 |
| WO | WO 2008/023800 | A1 | 2/2008 |
| WO | WO 2008/143220 | A1 | 11/2008 |

OTHER PUBLICATIONS

Jul. 27, 2010 Written Opinion of the International Searching Authority issued in International Application No. PCT/IB2010/000750.

Apr. 28, 2011 Office Action issued in Japanese Patent Application No. 2009-091534 (with Translation).

* cited by examiner

ANTENNA DEVICE

BACKGROUND OF THE INVENTION

1. Field of the Invention

The invention relates to an antenna device that is able to change its directivity.

2. Description of the Related Art

In an existing art, an antenna device called an ESPAR antenna is known as an antenna device that is able to change its directivity. For example, Japanese Patent Application Publication No. 2001-24431 (JP-A-2001-24431) describes the antenna device. The antenna device described in JP-A-2001-24431 has such a configuration that a plurality of passive elements are located at a quarter wavelength distance from a feed element and then a variable reactance element is connected to each of the passive elements. The directivity of the antenna device may be changed by varying the reactance value of each variable reactance element.

However, in the antenna device described in JP-A-2001-24431, the interval between the feed element and each passive element needs to be set to a quarter of wavelength, so it is difficult to reduce the size of the antenna device.

SUMMARY OF THE INVENTION

The invention provides an antenna device that is able to change its directivity and that is small in size.

A first aspect of the invention provides an antenna device. The antenna device includes: a plurality of loop metal wires that form loops out of metal wires and that are radially arranged around a center line; a power feeding portion that is provided on the center line and that feeds power to the loop metal wires; and a variable impedance element that is inserted in each of the loop metal wires.

A second aspect of the invention provides an antenna device. The antenna device includes: a plurality of loop metal wires that form loops out of metal wires and that are radially arranged around a center line; a power receiving portion that is provided on the center line and that receives power from the loop metal wires; and a variable impedance element that is inserted in each of the loop metal wires.

The shape of each loop is not specifically limited; instead, the shape may be formed of a curved line, such as a circle and an ellipse, the shape may be formed of straight lines, such as a triangle and a rectangle, or the shape may be formed of both a curved line and a straight line.

In addition, each loop metal wire is not necessarily completely independent of the other loop metal wires one by one; instead, part of the metal wires may be shared. In addition, a half of each loop metal wire may be formed by an electrical mirror image using a grounded conductor.

In the first and second aspects, each of the loop metal wires may form a triangular or rectangular loop.

In the first and second aspects, each of the loop metal wires may form a rectangular loop out of a linear first metal wire that is shared by the loop metal wires and that has the power feeding portion or the power receiving portion, mutually parallel two second metal wires that are respectively connected to both ends of the first metal wire so as to be perpendicular to the first metal wire, and a third metal wire that couples the two second metal wires and that inserts the variable impedance element therein.

In the above configuration, the length of the second metal wire may be three to five times as large as the length of the first metal wire and the third metal wires.

In any one of the above configurations, the variable impedance element may be a variable resistance element or may be a variable capacitor or a variable inductor.

In any one of the above configurations, the length of each of the loop metal wires in a direction perpendicular to the center line may be smaller than or equal to one-twentieth of a wavelength.

In any one of the above configurations, each of the loop metal wires may include an electrical mirror image formed by a grounded conductor.

According to the first and second aspects of the invention, radio waves reflected by the variable impedance element of one loop metal wire also propagate to the other loop metal wires. Then, when the impedance of the variable impedance element is varied, the phase and amplitude of reflected waves by that variable impedance element vary, so the phase and amplitude of radio waves propagating to the other loop metal wires also vary, and then the distribution of radio waves overall varies. Therefore, by changing the impedances of the variable impedance elements, the directivity of the antenna device may be varied. When the impedances of all the variable impedance elements are equal, the antenna device may be set to be nondirectional. In addition, the first and second aspects of the invention each have one power feeding portion and one power receiving portion, so they may be manufactured in low cost as compared with a directivity-variable antenna device in which a plurality of antenna elements need to feed or receive power. In addition, according to the first and second aspects of the invention, the size of the antenna device may be smaller than or equal to one-tenth of a wavelength of service radio waves.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, specific embodiments of the invention will be described with reference to the accompanying drawings; however, the aspect of the invention is not limited to the embodiments.

Figure 1:
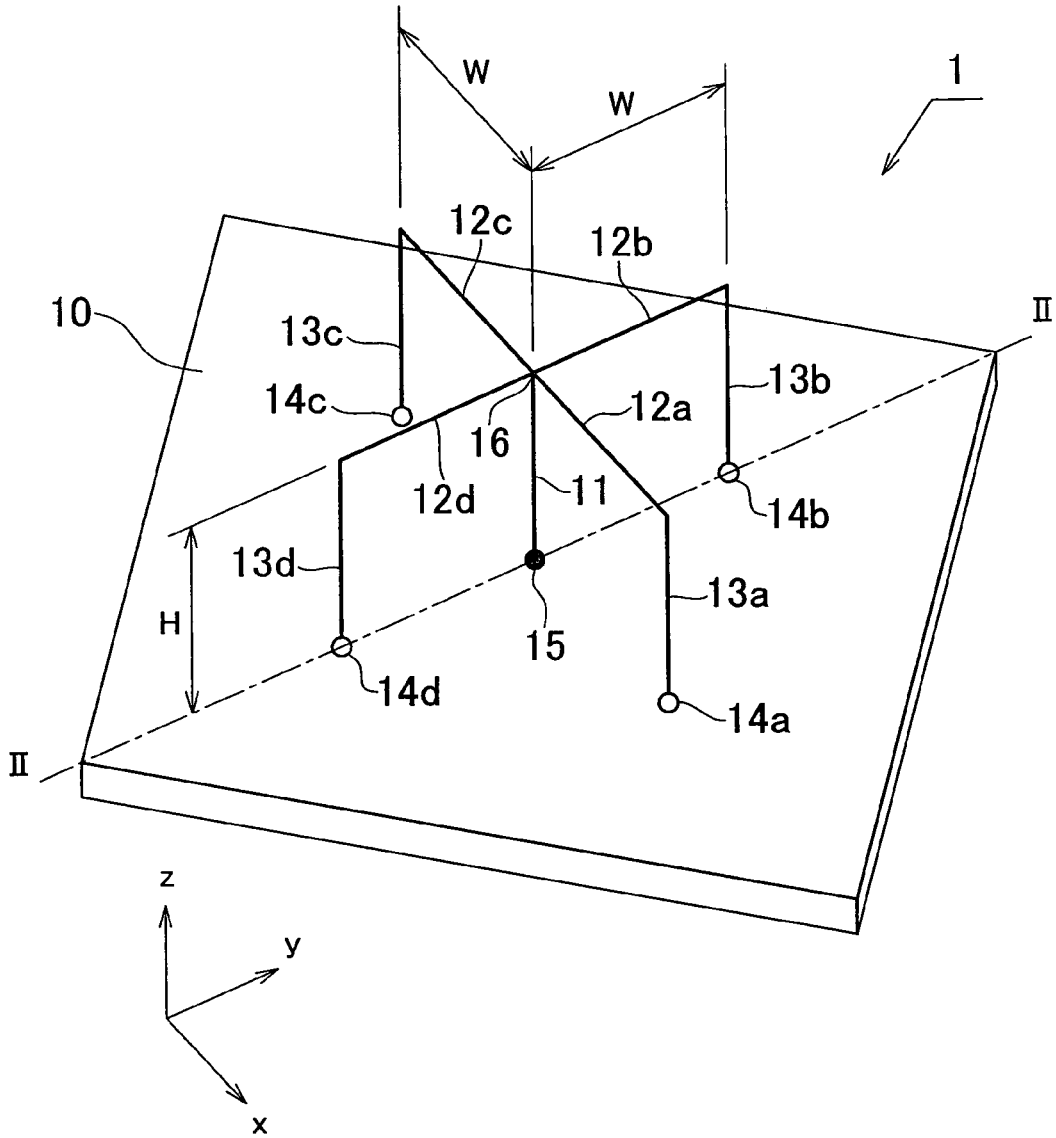
FIG. 1 is a view that shows the configuration of an antenna device according to a first embodiment.
Figure 2:
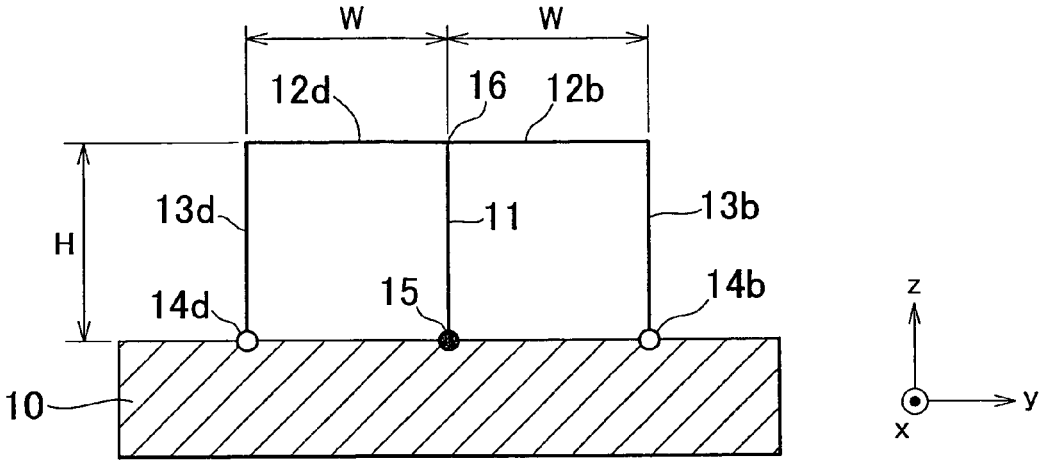
FIG. 2 is a cross-sectional view of the antenna device, taken along the line II-II in FIG. 1.

FIG. 1 is a view that shows the configuration of an antenna device 1 according to a first embodiment. In addition, FIG. 2 is a cross-sectional view taken along the line II-II in FIG. 1. The antenna device 1 includes a grounded metal plate 10 and a linear first metal wire 11 that is arranged vertically to the metal plate 10. Hereinafter, for the sake of easy description, as shown in FIG. 1, the z-axis is set vertically to the metal plate 10, and the x-axis and the y-axis are set in a plane parallel to the metal plate 10. A power feeding portion 15 is provided between the first metal wire 11 and the metal plate 10. Note that the antenna device 1 may be configured so that the power feeding portion 15 is replaced with a power receiving portion 15. The antenna device 1 having the power feeding portion 15 may be used as a transmitting antenna. The antenna device 1 having the power receiving portion 15 may be used as a receiving antenna.

Four linear second metal wires 12 are connected to an opposite end of the first metal wire 11 with respect to the power feeding portion 15. The second metal wires 12 extend in a direction parallel to the metal plate 10, that is, a direction perpendicular to the first metal wire 11. Hereinafter, a point at which the first metal wire 11 is connected to the four second metal wires 12 is termed a branch point 16. In addition, each of the four second metal wires 12 extends in a direction perpendicular to a direction in which the adjacent one of the four second metal wires 12 extends. Thus, the second metal wires 12 are radially arranged around the branch point 16 at equiangular intervals in directions perpendicular to the first metal wire 11. Here, among the four second metal wires 12, the one that extends from the branch point 16 in the positive x-axis direction is a second metal wire 12*a*, the one that extends in the negative x-axis direction is a second metal wire 12*c*, the one that extends in the positive y-axis direction is a second metal wire 12*b* and the one that extends in the negative y-axis direction is a second metal wire 12*d*.

Third metal wires 13*a* to 13*d* are respectively connected to opposite ends of the second metal wires 12*a* to 12*d* with respect to the ends connected to the first metal wire 11. The third metal wires 13*a* to 13*d* are vertical to the metal plate 10, and are respectively connected to the metal plate 10 via variable resistance elements 14*a* to 14*d*.

The antenna device 1 is configured so that four rectangular loops are radially arranged around the power feeding portion 15 by the first metal wire 11, the second metal wires 12, the third metal wires 13 and the electrical mirror images of these wires, formed by the metal plate 10. The rectangular loops function as loop metal wires according to the aspect of the invention.

Each variable resistance element 14 is an element in which a corresponding one of the third metal wires 13 is connected to an input port of an SPDT switch and then a 10Ω resistor and a 250Ω resistor are respectively connected to two output ports. The SPDT switch is switched to switch the resistance, connected to the corresponding third metal wire 13, between 10Ω and 250Ω to thereby achieve variable resistance. The SPDT switch is, for example, formed of two PIN diodes. The on/off state of each of the PIN diodes is controlled using a control voltage to thereby switch connection.

Next, the operation of the antenna device 1 will be described. Radio waves supplied from the power feeding portion 15 propagate through the metal plate 10 and the first metal wire 11. Radio waves propagating through the first metal wire 11 propagate from the branch point 16 to the four second metal wires 12*a* to 12*d* and then further propagate to the third metal wires 13*a* to 13*d*. During the propagation, radio waves leak and radiate little by little. Radiated radio waves differ in phase depending on a location of the radiation, and form directivity as in the case where power is fed to a plurality of discrete array antennas by phase difference feed.

Radio waves that are not radiated during propagation reach the variable resistance elements 14 and are then reflected or absorbed. Reflected radio waves propagate from the branch point 16 to the first metal wire 11 or the other three second metal wires 12 to thereby change the distribution of radio waves. That is, the distribution of radio waves in the second metal wires 12 and the third metal wires 13 is determined on the basis of radio waves that are fed from the power feeding portion 15, branched at the branch point 16 and propagating to the respective variable resistance elements 14*a* to 14*d*, radio waves reflected by the variable resistance elements 14 and radio waves that are reflected by the variable resistance elements 14, branched at the branch point 16 and propagating to the other variable resistance elements 14. In addition, the distribution of radio waves in the first metal wire 11 is determined on the basis of radio waves that are fed from the power feeding portion 15 and radio waves that are reflected by the variable resistance elements 14 and transmitted from the branch point 16 toward the power feeding portion 15. The radiation characteristics of the antenna device 1 are determined on the basis of these distributions of radio waves.

As the resistance of each variable resistance element 14 varies, the reflection amount and absorption amount of radio waves vary. Therefore, the amount of reflected radio waves propagating from the branch point 16 to the first metal wire 11 or the other three third metal wires 13 also varies. As a result, the distribution of radio waves of the overall antenna device 1 also varies, and then the radiation characteristics of the antenna device 1 vary.

Figure 3:
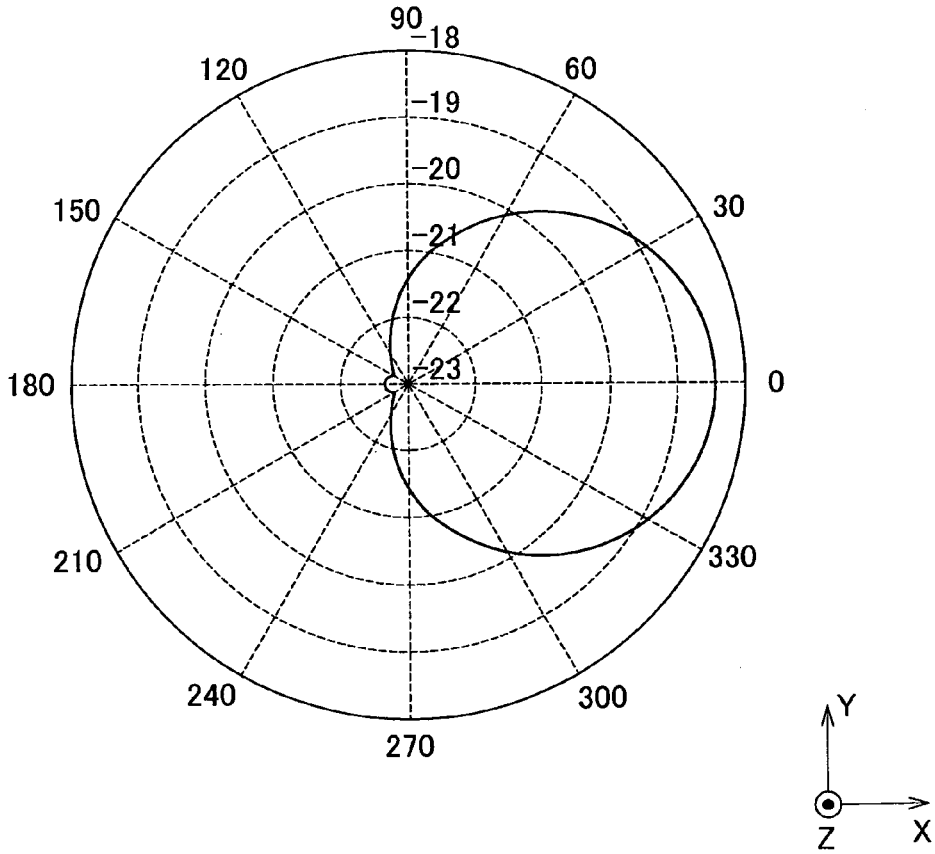
FIG. 3 is a graph that shows the radiation characteristics of the antenna device in the xy-plane.
Figure 4:
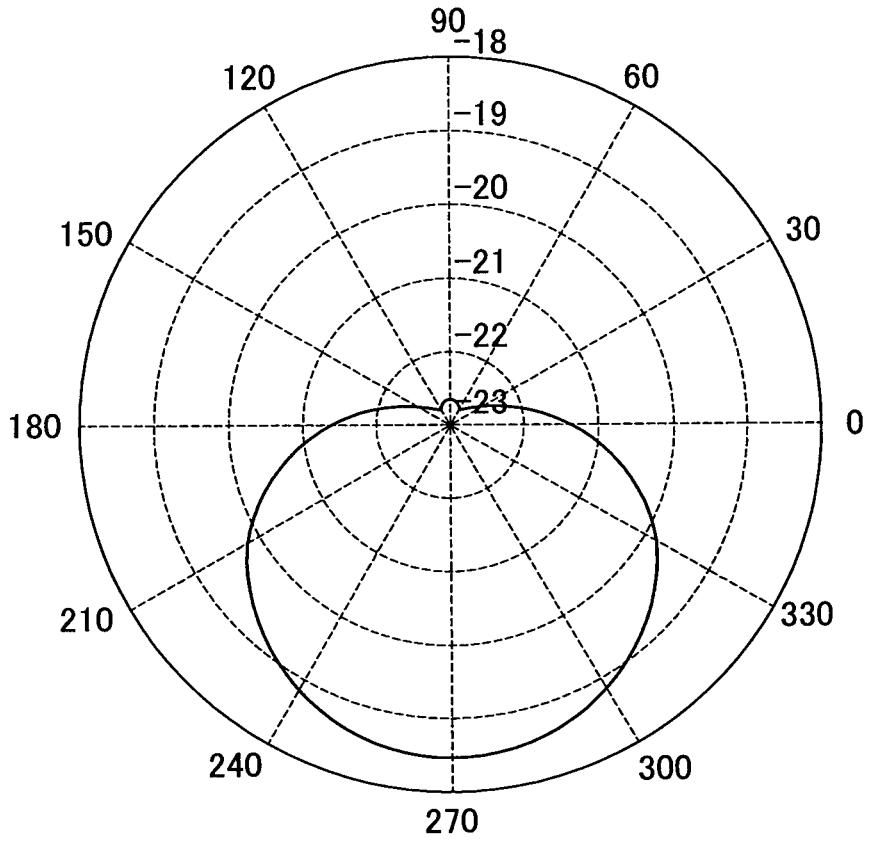
FIG. 4 is a graph that shows the radiation characteristics of the antenna device in the xy-plane.
Figure 5:
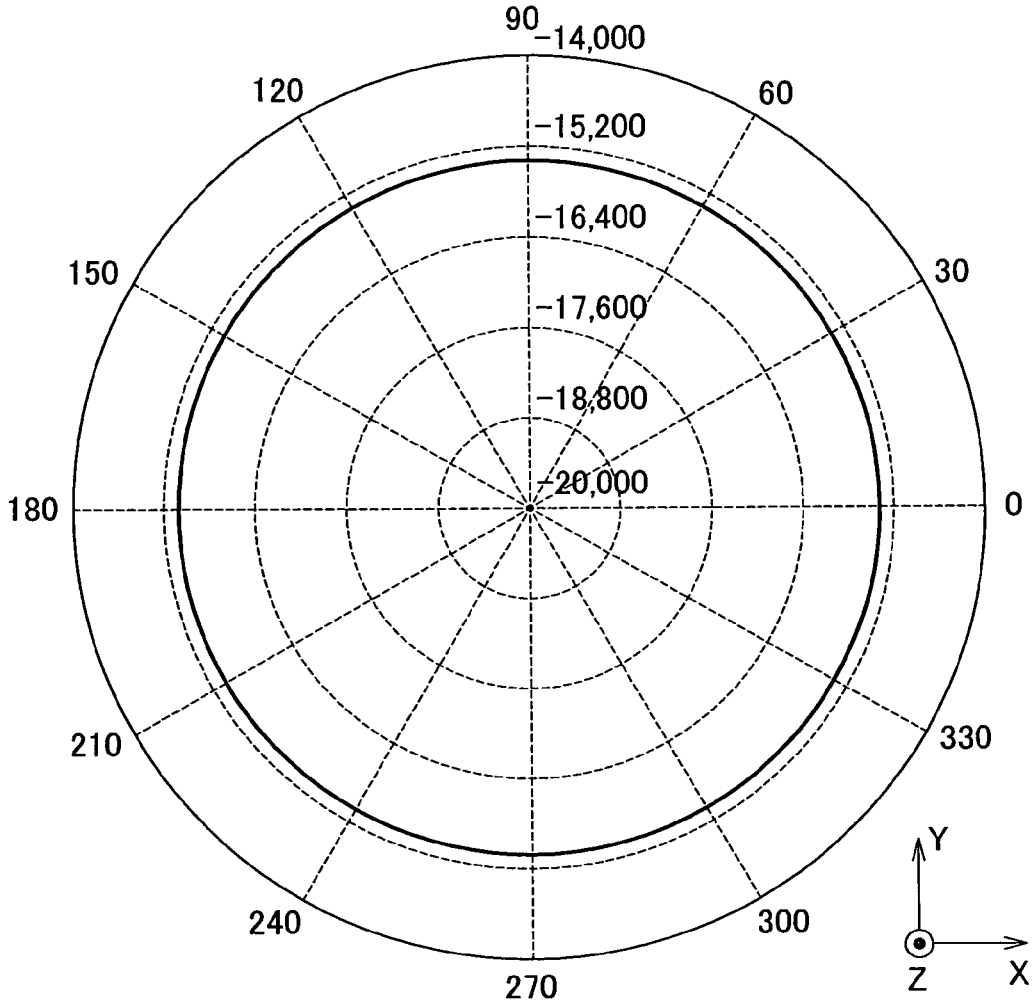
FIG. 5 is a graph that shows the radiation characteristics of the antenna device in the xy-plane.

FIG. 3 to FIG. 5 are graphs that show the radiation characteristics of the antenna device 1 in the xy-plane, obtained through simulation. In this simulation, the length H of each of the first metal wire 11 and the third metal wires 13 is set to 3 cm, the length W of each second metal wire 12 is set to 7 cm, and the analyzing frequency is set to 315 MHz (wavelength of about 95 cm).

FIG. 3 shows the radiation characteristics of the antenna device 1 when the variable resistance elements 14*a*, 14*b* and 14*d* are set to 10Ω and the variable resistance element 14*c* is set to 250Ω. It appears that, when the resistances of the four variable resistance elements 14 are selected in this way, both the F/B ratio and the F/S ratio of the antenna device 1 are about 3 dB and the antenna device 1 is able to form a directional beam that is directed in a direction from the variable resistance element 14*c* toward the variable resistance element 14*a* (positive x-axis direction).

FIG. 4 shows the radiation characteristics of the antenna device 1 when the variable resistance elements 14*a*, 14*c* and 14*d* are set to 10Ω and the variable resistance element 14*b* is set to 250Ω. In this case as well, as in the case of FIG. 3, it appears that both the F/B ratio and the F/S ratio of the antenna device 1 are about 3 dB and the antenna device 1 is able to form a directional beam that is directed in a direction from the variable resistance element 14*b* toward the variable resistance element 14*d* (negative y-axis direction).

From FIG. 3 and FIG. 4, it appears that directional beams in four directions, that is, positive and negative x-axis directions and positive and negative y-axis directions may be formed by changing the resistances of the four variable resistance elements 14.

In addition, FIG. 5 shows the radiation characteristics of the antenna device 1 when all the resistances of the four variable resistance elements 14*a* to 14*d* are set to 10Ω. All the reflection amounts of the respective variable resistance elements 14*a* to 14*d* are equal to one another, so the distribution of radio waves is symmetrical and then the radiation characteristics have no directivity as shown in FIG. 5.

As described above, the antenna device 1 according to the first embodiment is able to switch the beam among four directions by changing the resistances of the variable resistance elements 14, and may also be set to be nondirectional. In addition, because the length of each second metal wire 12 is 7 cm and the length of each of the first metal wire 11 and the third metal wires 13 is 3 cm, a variable-directivity antenna device may be formed to have a size that is smaller than or equal to one-tenth of the wavelength (about 95 cm).

Note that the length of each second metal wire 12 is desirably smaller than or equal to one-twentieth of the wavelength of a service frequency band. This is because formation of a directional beam is easy. In addition, the length W of each second metal wire 12 is desirably three to five times as large as the length H of each of the first metal wire 11 and the third metal wires 13. This is because a further sharp directional beam may be formed.

Figure 6:
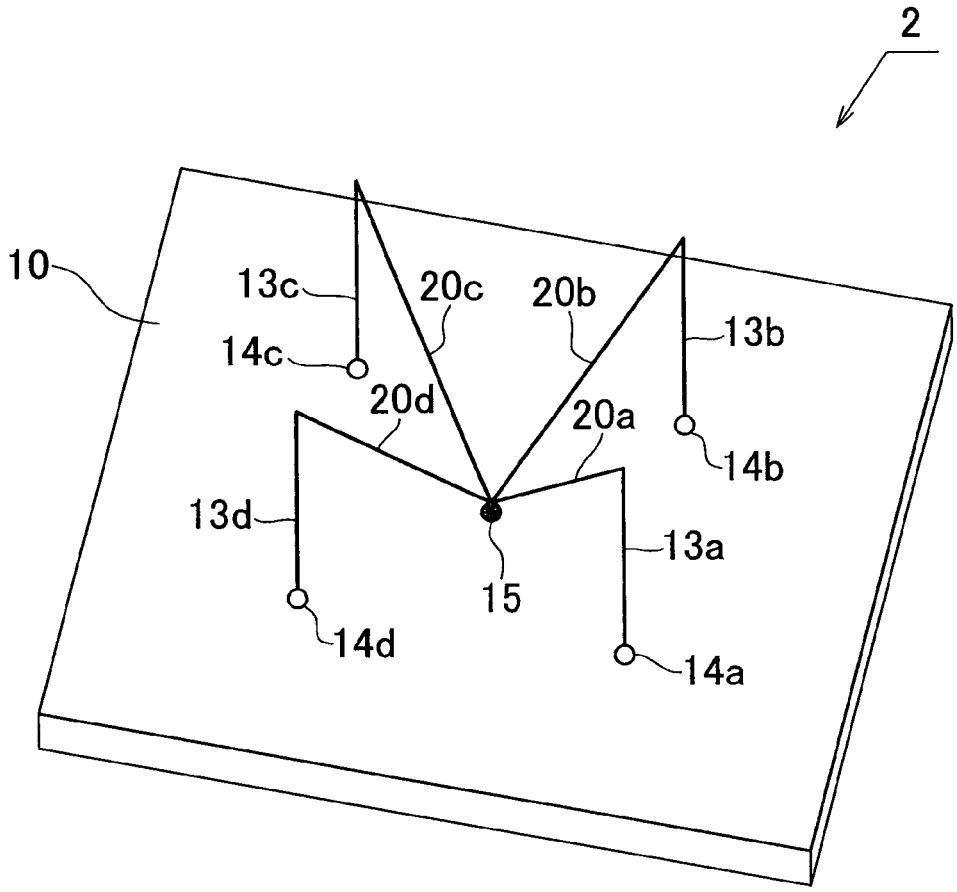
FIG. 6 is a view that shows the configuration of an antenna device according to a second embodiment.

FIG. 6 is a view that shows the configuration of an antenna device 2 according to a second embodiment. The antenna device 2 is configured so that, instead of the first metal wire 11 and the second metal wires 12, fourth metal wires 20*a* to 20*d* are provided to connect the power feeding portion 15 to opposite ends of the third metal wires 13*a* to 13*d* with respect to the ends connected to the metal plate 10. The antenna device 2 is configured so that four triangular loops are radially arranged around the power feeding portion 15 by the fourth metal wires 20, the third metal wires 13 and the electrical mirror images of these wires, formed by the metal plate 10.

In the antenna device 2, radio waves supplied from the power feeding portion 15 propagate to the fourth metal wires 20 and then propagate to the third metal wires 13. Then, radio waves reflected by one of the variable resistance elements 14 propagate to the other three fourth metal wires 20 via the power feeding portion 15. Thus, as in the case of the antenna device 1, by changing the resistances of the variable resistance elements 14, the distribution of radio waves overall varies, so the radiation characteristics of the antenna device 2 may be varied. In addition, the antenna device 2, as well as the antenna device 1, may be formed as a variable-directivity antenna device that has a size smaller than or equal to one-tenth of the wavelength of a service frequency band.

Figure 7:
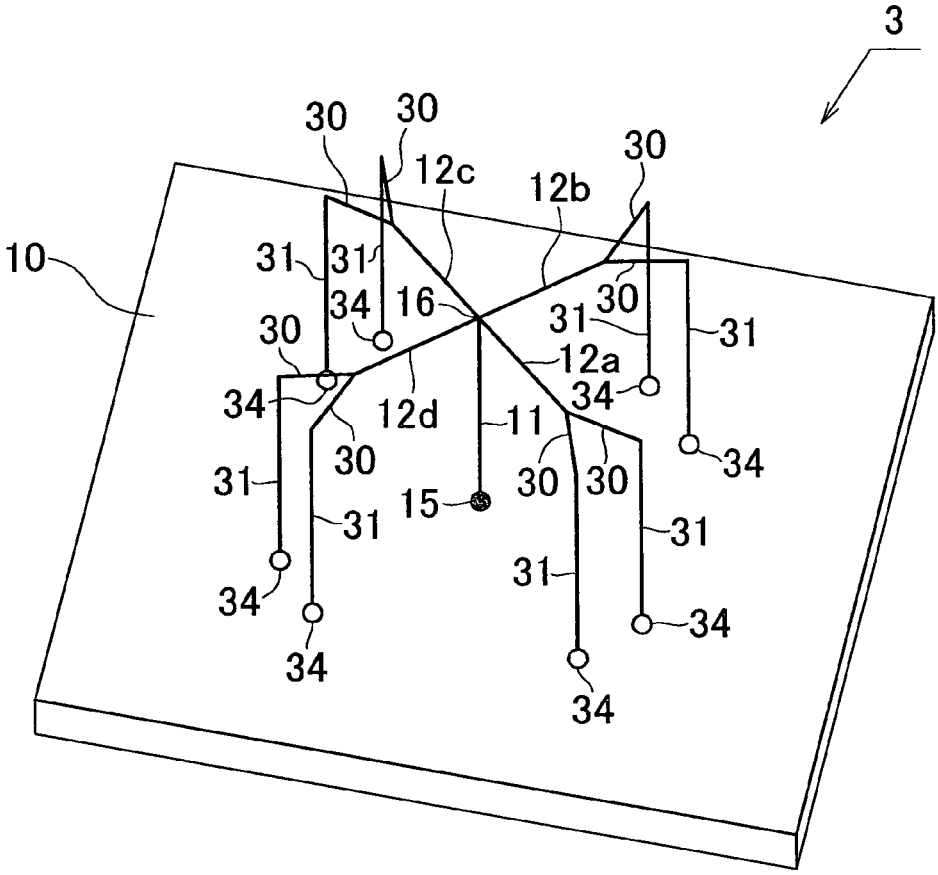
FIG. 7 is a view that shows the configuration of an antenna device according to a third embodiment.

FIG. 7 is a view that shows the configuration of an antenna device 3 according to a third embodiment. The antenna device 3 is configured so that, in the antenna device 1, each second metal wire 12 is branched into two fifth metal wires 30 at an end opposite to the branch point 16. Furthermore, sixth metal wires 31 vertical to the metal plate 10 are respectively connected to the ends of the fifth metal wires 30, and each sixth metal wire 31 is connected to the metal plate 10 via a variable resistance element 34.

In the antenna device 3, radio waves reflected by the variable resistance elements 34 are not only branched at the branch point 16 but also branched at a connecting point between each second metal wire 12 and the corresponding two fifth metal wires 30 and then propagated to thereby vary the distribution of radio waves. Thus, as in the case of the antenna device 1, by changing the resistances of the variable resistance elements 34, the distribution of radio waves overall varies, so the radiation characteristics of the antenna device 3 may be varied. Particularly, the second metal wires 12 are branched to provide the eight fifth metal wires 30 and then the variable resistance element 34 is provided for each of the fifth metal wires 30, so it is possible to further minutely control the directivity as compared with the antenna device 1 according to the first embodiment. In addition, the antenna device 3, as well as the antenna device 1, may be formed as a variable-directivity antenna device that has a size smaller than or equal to one-tenth of the wavelength of a service frequency band.

Note that, in the antenna device 3, each second metal wire 12 is branched into two; instead, it may be branched into three or more and the branching angle is selectable.

Figure 8:
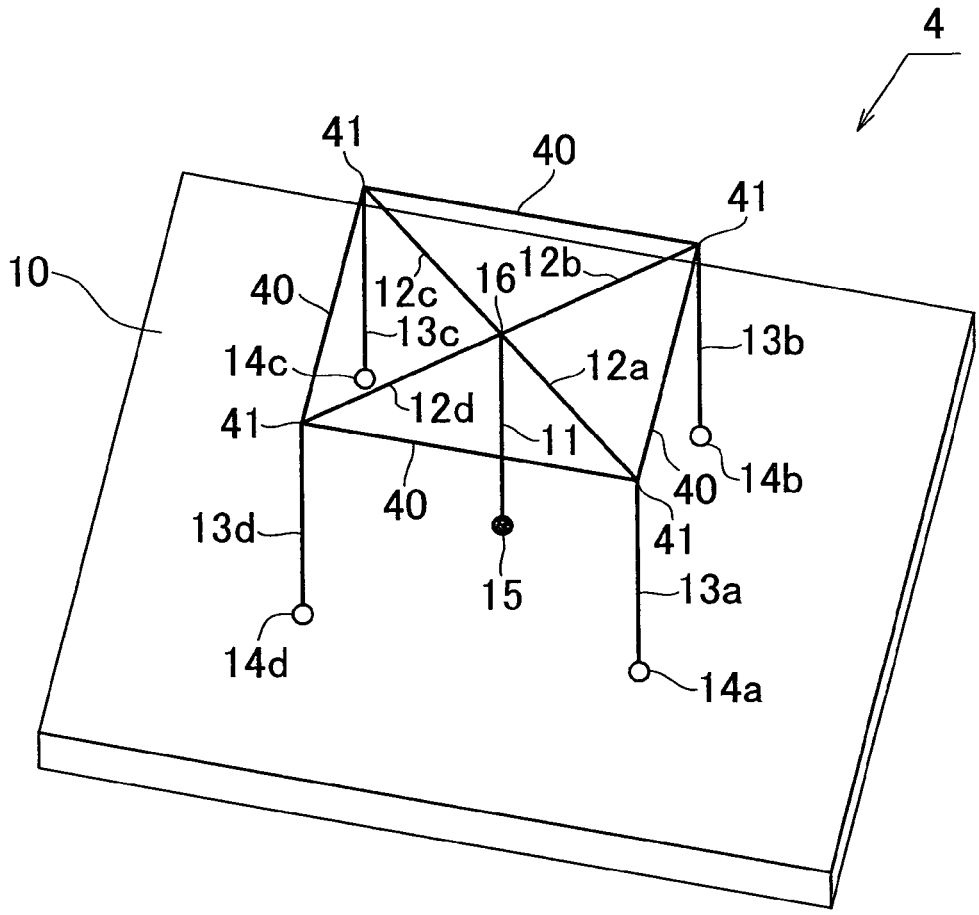
FIG. 8 is a view that shows the configuration of an antenna device according to a fourth embodiment.

FIG. 8 is a view that shows the configuration of an antenna device 4 according to a fourth embodiment. The antenna device 4 is configured so that, in the antenna device 1, four seventh metal wires 40 each are provided to connect a connecting point between one of the second metal wires 12 and a corresponding one of the third metal wires 13 to an adjacent connecting point between another one of the second metal wires 12 and a corresponding one of the third metal wires 13. Each seventh metal wire 40 is parallel to the metal plate 10 and makes 45 degrees with the second metal wires 12 connected thereto.

In the antenna device 4, radio waves reflected by the variable resistance elements 14 are not only branched at the branch point 16 but also branched at the connecting points 41 and then propagated to thereby vary the distribution of radio waves. Thus, as in the case of the antenna device 1, by changing the resistances of the variable resistance elements 14, the distribution of radio waves overall varies, so the radiation characteristics of the antenna device 4 may be varied. In addition, the antenna device 4, as well as the antenna device 1, may be formed as a variable-directivity antenna device that has a size smaller than or equal to one-tenth of the wavelength of a service frequency band.

In the second to fourth embodiments as well, as in the case of the first embodiment, the antenna device may be configured so that the power feeding portion is replaced with a power receiving portion.

Note that, in any embodiments, the loop metal wires are formed of the metal wires and the electrical mirror images formed by the metal plate; instead, loop metal wires may be formed only by the metal wires without using the metal plate.

In addition, in any embodiments, the four loop metal wires are provided radially around the power feeding portion 15; however, it is only necessary that the number of loop metal wires is two or more and the angle made by each loop metal wire may not be equal among the loop metal wires. When the number of loop metal wires is n, the appropriate resistances of the variable resistance elements are selected to thereby make it possible to implement an antenna device that is able to switch among directional beams in directions of n or below and non-directivity.

In addition, in any embodiments, each loop metal wire is formed of a straight line; instead, it may be formed of a curved line or may be formed of both a straight line and a curved line.

In addition, in any embodiments, it is not always necessary to use the variable resistance elements; it is only necessary that impedance-variable elements are used. For example, variable capacitors or variable inductors may be connected in series or in parallel with the metal wires.

The antenna device according to the aspect of the invention may be used for wireless communication.

The invention claimed is:

1. An antenna device comprising:

a grounded metal plate;

a linear first metal wire arranged vertically to the metal plate;

a power feeding or receiving portion that is provided between the first metal wire and the metal plate and that is adapted to feed or receive power to or from a plurality of linear second metal wires;

the plurality of second metal wires having first ends which are connected to the first metal wire, the plurality of second metal wires being radially arranged around the first metal wire, and extending in a direction parallel to the metal plate;

third metal wires connected to second ends of the second metal wires opposite to the first ends of the second metal wires connected to the first metal wire, the third metal wires being vertical to the metal plate; and variable impedance elements comprising variable resistance elements that connect the third metal wires to the metal plate, wherein loops are formed by the first, second and third metal wires and electrical mirror images of the first, second, and third metal wires formed by the metal plate, and wherein the resistance of each variable resistance element is variable, thereby a reflection amount and an absorption amount of radio waves propagating through the third metal wires are varied, wherein the reflection amount comprises an amount of radio waves reflected at each of connecting points of the third metal wires and corresponding variable resistance elements, and the absorption amount comprises an amount of radio waves absorbed by each of the variable resistance elements, thereby the distribution of radio waves in the second metal wires and the third metal wires is variable, and thereby the directivity of the antenna device in a plane perpendicular to the first metal wire is variable.

2. An antenna device comprising:

a grounded metal plate;

a power feeding or receiving portion provided between a plurality of fourth metal wires and the metal plate, the plurality of fourth metal wires connected to the power feeding or receiving portion;

third metal wires connected to opposite ends of the fourth metal wires with respect to the ends of the fourth metal wires connected to the power feeding or receiving portion; and variable impedance elements comprising variable resistance elements that connect the third metal wires to the metal plate, wherein triangular loops are formed by the third and fourth metals wires and electrical mirror images of the third and fourth metal wires formed by the metal plate and wherein the resistance of each variable resistance element is variable, thereby a reflection amount and an absorption amount of radio waves propagating through the third metal wires are varied wherein the reflection amount comprises an amount of radio waves reflected at each of connecting points of the third metal wires and corresponding variable resistance elements, and the absorption amount comprises an amount of radio waves absorbed by each of the variable resistance elements, thereby the distribution of radio waves in the third metal wires and the fourth metal wires is variable, and thereby the directivity of the antenna device is variable.

3. The antenna device according to claim 1, wherein the length of at least one of the plurality of linear second metal wires is three to five times as large as the length of the first metal wire and at least one of the third metal wires.

4. The antenna device according to claim 1, wherein the variable impedance element is a variable resistance element.

5. The antenna device according to claim 1, wherein the variable impedance element is a variable capacitor or a variable inductor.

6. The antenna device according to claim 1, wherein the length of each of the second metal wires in a direction perpendicular to the first metal wire is smaller than or equal to one-twentieth of a wavelength.

7. The antenna device according to claim 1, wherein each of the loops includes an electrical mirror image formed by a grounded conductor.

* * * * *